US005985537A

United States Patent [19]

Philip, Jr. et al.

[11] Patent Number: 5,985,537

[45] Date of Patent: Nov. 16, 1999

[54] PHOTOTHERMOGRAPHIC ELEMENTS INCORPORATING ANTIHALATION DYES

[75] Inventors: James B. Philip, Jr., Mahtomedi; Charles W. Gomez, Cottage Grove, both of Minn.

[73] Assignee: Minnesota, Mining & Manufacturing Co., St. Paul, Minn.

[21] Appl. No.: 08/150,465

[22] Filed: Nov. 10, 1993

[51] Int. Cl.[6] ..... G03C 1/498

[52] U.S. Cl. ..... 430/619; 430/510; 430/517; 430/522; 430/523

[58] Field of Search ..... 430/619, 522, 430/523, 330, 517, 510

[56] References Cited

U.S. PATENT DOCUMENTS

| | | | |
|---|---|---|---|
| 4,581,325 | 4/1986 | Kitchin et al. | 430/617 |
| 4,835,096 | 5/1989 | Lea | 430/619 |
| 4,839,265 | 6/1989 | Ohno et al. | 430/522 |
| 5,153,112 | 10/1992 | Toshida et al. | 430/522 |

*Primary Examiner*—Thorl Chea

[57] ABSTRACT

A photothermographic element comprising a substrate having on at least one side thereof a photothermographic system comprising silver halide spectrally sensitized to the infrared region of the electromagnetic spectrum, a light insensitive silver source, a reducing agent for silver ion, and a binder, said element further comprising at least one layer which contains an infrared-absorbing dye having a central nucleus of the formula wherein n is an integer of 1 to 12, Q is an ionic acidic moiety, and M is a cation, in an amount sufficient as to provide a transmission optical density of at least 0.1 at the wavelength of maximum sensitivity of said sensitized silver halide.

20 Claims, No Drawings

PHOTOTHERMOGRAPHIC ELEMENTS INCORPORATING ANTIHALATION DYES

FIELD OF THE INVENTION

This invention relates to a photothermographic element having an antihalation layer.

BACKGROUND OF THE INVENTION

Light sensitive recording materials may suffer from a phenomenon known as halation which causes degradation in the quality of the recorded image. Such degradation may occur when a fraction of the imaging light which strikes the photosensitive layer is not absorbed but passes through to the film base on which the photosensitive layer is coated. A portion of the light reaching the base may be reflected back to strike the photosensitive layer from the underside. Light thus reflected may, in some cases, contribute significantly to the total exposure of the photosensitive layer. Any particulate matter in the photosensitive element, including silver salts, may cause light passing through the element to be scattered. Scattered light which is reflected from the film base will, on its second passage through the photosensitive layers cause exposure over an area adjacent to the point of intended exposure. It is this adjacent exposure effect which leads to image degradation. Silver halide based photographic materials (including photothermographic materials) are particularly prone to this form of image degradation since the photosensitive layers contain light scattering particles. The effect of light scatter on image quality is well documented and is described, for example, in T. H. James "The Theory of the Photographic Process", 4th Edition, Chapter 20, Macmillan 1977.

It is common practice to minimize the effects of light scatter by including a light absorbing layer within the photographic element. To be effective, the absorption of this layer must be at the same wavelengths as the sensitivity of the photosensitive layer. In the case of imaging materials coated on transparent base, a light absorbing layer is frequently coated on the reverse side of the base from the photosensitive layer. Such a coating, known as an "antihalation layer", effectively prevents reflection of any light which has passed through the photosensitive layer.

A similar effect may be achieved by a light absorbing layer interposed between the photosensitive layer and the base. This construction, described as an "antihalation underlayer" is applicable to photosensitive coatings on transparent or non-transparent bases. It is also possible to improve image quality by coating a light absorbing layer above the photosensitive layer of a photographic or photothermographic element. Coatings of this kind, described in U.S. Pat. Nos. 4,581,323 and 4,312,941, prevent multiple reflections of scattered light between the internal surfaces of a photosensitive element.

Photothermographic antihalation systems for infrared materials have been described previously. However, these usually had some disadvantages. A strippable antihalation coating of infrared absorbing pigment such as carbon black is described in U.S. Pat. Nos. 4,477,562 and 4,409,316. A strippable layer would generally have adhesion difficulties in processes such as coating, converting and packaging and also generates a sheet of pigmented waste material. For these reasons, it is not a desirable solution to the problem.

European Patent Application 0 377 961 and U.S. Pat. No. 4,581,325 describe infrared antihalation systems for photographic and photothermographic materials incorporating polymethine and holopolar dyes respectively. However, these dyes although having good infrared absorbance, have visible absorbance that is too high for use in subsequent exposures or viewing an image.

An antihalation system that has a high infrared absorbance before processing and a low visible absorbance after processing is the thermal-dye-bleach construction described in European Patent Application 0 403 157. The bleaching, infrared antihalation system uses a polymethine dye which is converted to a colorless derivative on heat processing. However, the system is not heat stable and as the dye decomposes,the infrared absorbance decreases with time.

Indolenine dyes have been described as infrared antihalation dyes in silver halide, photographic materials in U.S. Pat. Nos. 2,895,955; 4,882,265; 4,876,181; 4,839,265 and 4,871,656 and Japanese Patent Application J63 195656. Infrared absorbing indolenine dyes have been described for electrophotography in U.S. Pat. No. 4,362,800 and for optical laser recording material in Japanese Patent Applications J6 2082-082A and J6 3033-477.

Water insoluble indolenine dyes have been used in photothermographic systems as weak sensitizing dyes in U.S. patent application No. U.S. Ser. No. 07/846,919 filed Apr. 13, 1992 and as a combined supersensitizer-antihalation system in Japanese Patent Application J4 182640.

However, the combination of infrared absorbing, water soluble indolenine dyes in a hydrophilic binder for photothermographic antihalation systems has not been described.

SUMMARY OF THE INVENTION

Therefore, according to the present invention there is provided an infrared sensitized photothermographic material comprising one or more photosensitive layers and, as an antihalation system, a water soluble antihalation dye in a hydrophilic binder. A further requirement of the non-bleaching, infrared antihalation dye is that the coated material have an infrared peak absorbance to visible absorbance ratio of greater than or equal to 30 to 1. The ratio of infrared absorbance to visible absorbance is measured by determining the transmission optical density of the layer at the wavelength of maximum absorbance in the IR ($OD_{TIR}$) and the transmission optical density of the same layer as an average value over the visible ($OD_{TVIS}$) region of the spectrum. The infrared is defined as 750–1400 nm and the visible range is 360–750 nm for the purposes of this invention.

The water soluble antihalation dyes have a central nucleus of the formula:

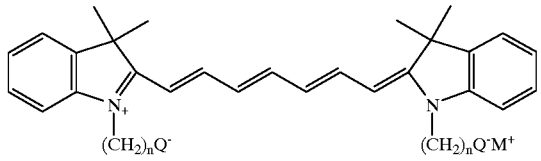

wherein n is an integer of 1 to 12, preferably 2 to 4,

Q is an acid moiety, e.g., carboxylic acid, sulfonic acid, sulfonic acid, sulfonylic acid, phosphonic acid, and the like, or sulfonamido or carbonamido, and M is a counter-cation, especially a cation such as alkali metal or ammonium.

The dye compound represented by formula (I) described above and used in this invention is illustrated by examples in the following; however, the scope of this invention is not limited to them.
D-1
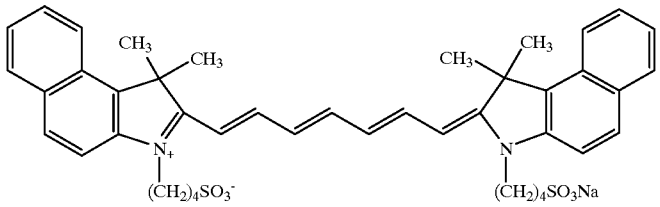
D-2
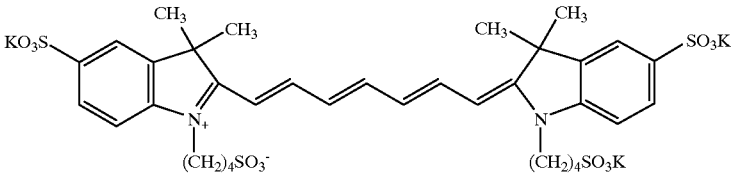
D-3
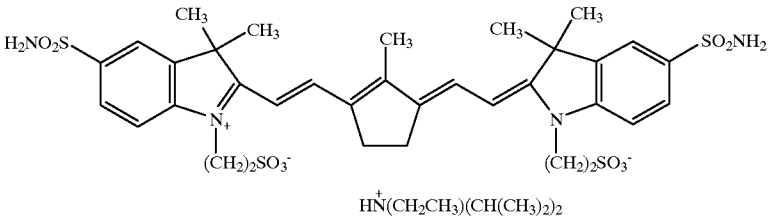
D-4
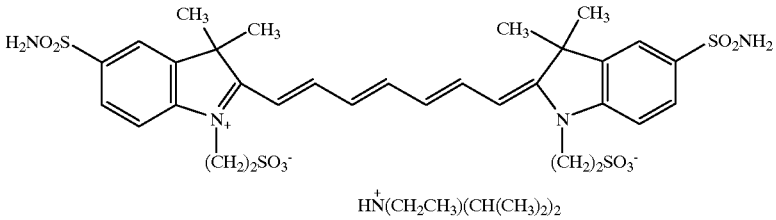
D-5
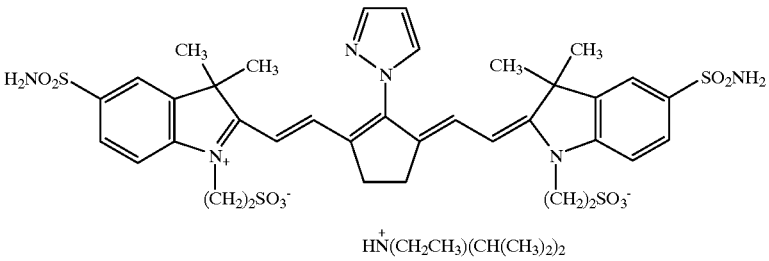
D-6
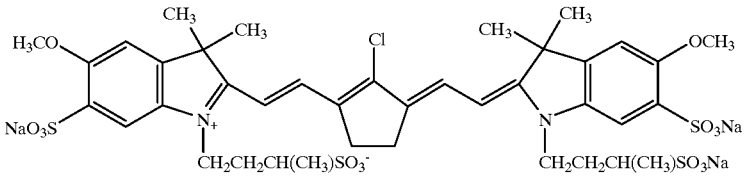

-continued

D-7

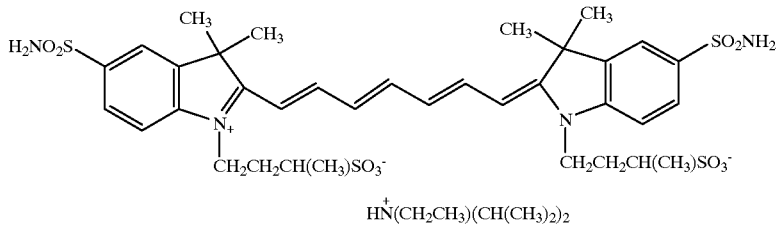

In the technical area of the present invention, there is substantial background in the art which allows for many variations in substitutions on compounds used in the practice of the invention. To indicate this art recognized acceptance of substitution, the following nomenclature is used in describing compounds and their substituents. Where the term "group" or "central nucleus" is used to describe a chemical species as in alkyl group, aryl group, heterocyclic group, or imidazole group, that terminology is specifically intended to include both substituted and unsubstituted species. For example, an alkyl group would include all unsubstituted alkyl structures such as methyl, ethyl, propyl, hexyl, iso-octyl, dodecyl, etc., and would also include alkyl structures with substitution thereon such as hydroxymethyl, 2-chloroethyl, 3-carboxypropyl, 6-ethoxyethyl, perfluorododecyl, and the like. All convention substitutions, as understood in the relevant art, are allowed on the central structure (e.g., alkyl) and are included within the term "group". Where the term "alkyl" or "alkyl moiety" is used without calling it a group, that term allows for only the strict chemical structure to be included within the term. For example, aryl covers only phenyl, naphthyl, and other aromatic rings without exocyclic substitution thereon. Aryl group or "central nucleus" on the other hand allows for any conventional substitution on the aryl ring or defined nucleus. As the invention is practiced within an art recognized field, this type of substitution and the contemplated scope of that substitution is well understood.

The aromatic groups at the end of the formula may of course be further substituted with such common substituents as fused rings (e.g., so as to form napthyl or anthranyl groups), alkyl, alkoxy, halo, cyano, nitro, etc., but most preferred are fused rings and/or acid groups, sulfonamido groups, and carbonamido groups. These groups may have cations associated therewith so that the groups are salts rather than strictly acids.

The water soluble, antihalation dyes are generally added to the photothermographic material in a sufficient amount to provide a transmissive optical density of greater than 0.1 at $\lambda_{max}$ of the dye. Generally, the coating weight of the dye which will provide the desired effect is from 5 to 200 mg/meter$^2$ more preferably as 10 to 150 mg/meters$^2$.

Water solubility is defined in this invention as the capability of dissolving at least 0.01 g dye in 100 g of deionized water and more preferably the capability of dissolving 0.10 g dye or more in 100 g of deionized water.

The photothermographic emulsions of this invention may be constructed of one or more layers on a substrate. Single layer constructions must contain the silver source material, the silver halide, the developer and binder as well as optional additional materials such as toners, coating aids, and other adjuvants. Two-layer constructions must contain the silver source and silver halide in one emulsion layer (usually the layer adjacent to the substrate) and some of the other ingredients in the second layer or both layers, although two layer constructions comprising a single emulsion layer containing all the ingredients and a protective topcoat are envisioned. Multicolor photothermographic constructions may contain sets of these bilayers for each color, or they may contain all ingredients within a single layer as described in U.S. Pat. No. 4,708,928. In the case of multilayer multicolor photothermographic articles the various emulsion layers are generally maintained distinct from each other by the use of functional or non-functional barrier layers between the various photosensitive layers as described in U.S. Pat. No. 4,460,681.

While not necessary for practice of the present invention, it may be advantageous to add mercury (II) salts to the emulsion layer(s) as an antifoggant. Preferred mercury (II) salts for this purpose are mercuric acetate and mercuric bromide.

The light sensitive silver halide used in the present invention may typically be employed in a range of 0.75 to 25 mol percent and, preferably, from 2 to 20 mol percent of organic silver salt.

The silver halide may be any photosensitive silver halide such as silver bromide, silver iodide, silver chloride, silver bromoiodide, silver chlorobromoiodide, silver chlorobromide, etc. The silver halide may be in any form which is photosensitive including, but not limited to cubic, orthorhombic, tabular, tetrahedral, etc., and may have epitaxial growth of crystals thereon.

The silver halide used in the present invention may be employed without modification. However, it may be chemically sensitized with a chemical sensitizing agent such as a compound containing sulfur, selenium or tellurium etc., or a compound containing gold, platinum, palladium, rhodium or iridium, etc., a reducing agent such as a tin halide, etc., or a combination thereof. The details of these procedures are described in T. H. James "The Theory of the Photographic Process", Fourth Edition, Chapter 5, pages 149 to 169.

The silver halide may be added to the emulsion layer in any fashion which places it in catalytic proximity to the silver source. Silver halide and the organic silver salt which are separately formed or "preformed" in a binder can be mixed prior to use to prepare a coating solution, but it is also effective to blend both of them in a ball mill for a long period of time. Further, it is effective to use a process which comprises adding a halogen-containing compound in the organic silver salt prepared to partially convert the silver of the organic silver salt to silver halide.

Methods of preparing these silver halide and organic silver salts and manners of blending them are known in the art and described in Research Disclosure, June 1978, item 17029, and U.S. Pat. No. 3,700,458.

The use of preformed silver halide emulsions of this invention can be unwashed or washed to remove soluble salts. In the latter case the soluble salts can be removed by chill-setting and leaching or the emulsion can be coagulation washed, e.g., by the procedures described in U.S. Pat. Nos. 2,618,556; 2,614,928; 2,565,418; 3,241,969; and 2,489,341. The silver halide grains may have any crystalline habit including, but not limited to cubic, tetrahedral, orthorhombic, tabular, laminar, platelet, etc.

The organic silver salt may be any organic material which contains a reducible source of silver ions. Silver salts of organic acids, particularly long chain (10 to 30 preferably 15 to 28 carbon atoms) fatty carboxylic acids are preferred. Complexes of organic or inorganic silver salts wherein the ligand has a gross stability constant between 4.0 and 10.0 are also desirable. The silver source material should preferably constitute from about 5 to 30 percent by weight of the imaging layer.

The organic silver salt which can be used in the present invention is a silver salt which is comparatively stable to light, but forms a silver image when heated to 80° C. or higher in the presence of an exposed photocatalyst (such as photographic silver halide) and a reducing agent.

Preferred organic silver salts include silver salts of organic compounds having a carboxy group. Non-limiting examples thereof include silver salts of an aliphatic carboxylic acid and a silver salt of an aromatic carboxylic acid. Preferred examples of the silver salts of aliphatic carboxylic acids include silver behenate, silver stearate, silver oleate, silver laurate, silver caproate, silver myristate, silver palmitate, silver maleate, silver fumarate, silver tartrate, silver linoleate, silver butyrate and silver camphorate, mixtures thereof, etc. Silver salts with a halogen atom or a hydroxyl on the aliphatic carboxylic acid can also be effectively used. Preferred examples of the silver salts of aromatic carboxylic acids and other carboxyl group-containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenyl benzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663, etc.

Silver salts of compounds containing mercapto or thione groups and derivatives thereof can also be used. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido) benzothiazole, a silver salt of thioglycolic acid such as a silver salt of an S-alkyl thioglycolic acid (wherein the alkyl group has from 12 to 22 carbon atoms), a silver salt of a dithiocarboxylic acid such as a silver salt of dithioacetic acid, a silver salt of a thioamide, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptotriazole derivative such as a silver salt of 3-amino-5-benzylthio-1,2,4-triazole, a silver salt of a thione compound such as a silver salt of 3-(2-carboxyethyl)-4-methyl-4-thiazoline-2-thione as disclosed in U.S. Pat. No. 3,301,678.

Furthermore, a silver salt of a compound containing an imino group may be used. Preferred examples of these compounds include silver salts of benzotriazole and derivatives thereof, for example, silver salts of benzotriazoles such as silver methylbenzotriazolate, etc., silver salt of halogen-substituted benzotriazoles, such as silver 5-chlorobenzotriazolate, etc., silver salts of carboimidobenzotriazole, etc., silver salt of 1,2,4-triazoles or 1-H-tetrazoles as described in U.S. Pat. No. 4,220,709, silver salts of imidazoles and imidazole derivatives, and the like. Various silver acetylide compounds can also be used, for instance, as described in U.S. Pat. Nos. 4,761,361 and 4,775,613.

It is also found convenient to use silver half soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about four or five percent of free behenic acid and analyzing about 25.2 percent silver may be used.

The method used for making silver soap dispersions is well known in the art and is disclosed in *Research Disclosure*, April 1983, item 22812, *Research Disclosure*, October 1983, item 23419 and U.S. Pat. No. 3,985,565.

The light-sensitive silver halides may be advantageously spectrally sensitized with various known dyes including cyanine, merocyanine, styryl, hemicyanine, oxonol, hemioxonol and xanthene dyes. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective. Practically, the sensitizing dyes to be used in the present invention may be properly selected from known dyes such as those described in U.S. Pat. Nos. 3,761,279, 3,719,495, and 3,877,943, British Pat. Nos. 1,466,201, 1,469,117 and 1,422,057, and can be located in the vicinity of the photocatalyst according to known methods. Spectral sensitizing dyes may be typically used in amounts of about $10^{-4}$ mol to about 1 mol per 1 mol of silver halide.

The reducing agent for the organic silver salt may be any material, preferably organic material, that can reduce silver ion to metallic silver. Conventional photographic developers such as phenidone, hydroquinones, and catechol are useful but hindered phenol reducing agents are preferred. The reducing agent should be present as 1 to 10 percent by weight of the imaging layer. In multilayer constructions, if the reducing agent is added to a layer other than an emulsion layer, slightly higher proportions, of from about 2 to 15 percent tend to be more desirable.

A wide range of reducing agents have been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionyl-β-phenylhydrazide in combination with ascorbic acid; a combination of polyhydroxybenzene and hydroxylamine, a reductone and/or a hydrazine (e.g., a combination of hydroquinone and bis (ethoxyethyl)hydroxylamine, piperidinohexose reductone or formyl-4-methylphenylhydrazine); hydroxamic acids such as phenylhydroxamic acid, p-hydroxyphenylhydroxamic acid, and β-alaninehydroxamic acid; a combination of azines and sulfonamidophenols, (e.g., phenothiazine and 2,6-dichloro-4-benzenesulfonamidophenol); α-cyanophenylacetic acid derivatives such as ethyl-α-cyano-2-methylphenylacetate, ethyl α-cyanophenylacetate; bis-β-naphthols as illustrated by 2,2'-dihydroxyl-1-binaphthyl, 6,6'-dibromo-2,2'-dihydroxy-1,1'-binaphthyl, and bis(2-hydroxy-1-naphthyl)methane; a combination of bis-β-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydropiperidonehexose reductone; sulfonamidophenol reducing agents such as 2,6-dichloro-4-benzenesulfonamidophenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols (e.g., bis(2-hydroxy-3-t-butyl- 5-methylphenyl) methane, 2,2-bis(4-hydroxy-3-methylphenyl)propane, 4,4-ethylidene-bis(2-t-butyl-6-methylphenol), and 2,2-bis(3,5-dimethyl-4-hydroxyphenyl)propane); ascorbic acid derivatives (e.g., 1-ascorbyl palmitate, ascorbyl stearate); and unsaturated aldehydes and ketones, such as benzil and biacetyl; 3-pyrazolidones and certain indane-1,3-diones.

In addition to the aforementioned ingredients, it may be advantageous to include additives known as "toners" that improve the image. Toner materials may be present, for example, in amounts from 0.1 to 10 percent by weight of all silver bearing components. Toners are well known materials in the photothermographic art as shown in U.S. Pat. Nos. 3,080,254; 3,847,612 and 4,123,282.

Examples of toners include phthalimide and N-hydroxyphthalimide; cyclic imides such as succinimide, pyrazoline-5-ones, and a quinazolinone, 3-phenyl-2-pyrazoline-5-one, 1-phenylurazole, quinazoline, and 2,4-thiazolidinedione; naphthalimides (e.g., N-hydroxy-1,8-naphthalimide); cobalt complexes (e.g., cobaltic hexammine trifluoroacetate); mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, (e.g., (N,N-dimethylaminomethyl)phthalimide, and N,N-(dimethylaminomethyl)naphthalene-2,3-dicarboximide); and a combination of blocked pyrazoles, isothiuronium derivatives and certain photobleaching agents (e.g., a combination of N,N'-hexamethylene bis(1-carbamoyl-3,5-dimethylpyrazole), 1,8-(3,6-diazaoctane)bis(isothiuronium trifluoroacetate) and 2-(tribromomethylsulfonyl) benzothiazole); and merocyanine dyes such as 3-ethyl-5[(3-ethyl-2-benzothiazolinylidene)-1-methylethylidene]-2-thio-2,4-oxazolidinedione; phthalazinone and phthalazinone derivatives or metal salts or these derivatives such as 4-(1-naphthyl)phthalazinone, 6-chlorophthalazinone, 5,7-dimethoxyphthalazinone, and 2,3-dihydro-1,4-phthalazinedione; a combination of phthalazinone plus sulfonic acid derivatives (e.g., phthalic acid, 4-methylphthalic acid, 4-nitrophthalic acid, and tetrachlorophthalic anhydride); quinazolinediones, benzoxazine or naphthoxazine derivatives; rhodium complexes functioning not only as tone modifiers, but also as sources of halide ion for silver halide formation in situ, such as ammonium hexachlororhodate (III), rhodium bromide, rhodium nitrate and potassium hexachlororhodate (III); inorganic peroxides and persulfates (e.g., ammonium peroxydisulfate and hydrogen peroxide); benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asymmetric triazines (e.g., 2,4-dihydroxypyrimidine, 2-hydroxy-4-aminopyrimidine), azauracils, and tetrazapentalene derivatives (e.g, 3,6-dimercapto-1,4-diphenyl-1H,4H-2,3a,5,6a-tetrazapentalene, and 1,4-di(o-chlorophenyl)-3,6-dimercapto-1H,4H-2,3a,5,6a-tetrazapentalene).

A number of methods are known in the art for obtaining color images with dry silver systems including: a combination of silver benzotriazole, well known magenta, yellow and cyan dye-forming couplers, aminophenol developing agents, a base release agent such as guanidinium trichloroacetate and silver bromide in poly(vinyl butyral) as described in U.S. Pat. Nos. 4,847,188 and 5,064,742; preformed dye release systems such as those described in U.S. Pat. No. 4,678,739; a combination of silver bromoiodide, sulfonamidophenol reducing agent, silver behenate, poly (vinyl butyral), an amine such as n-octadecylamine and 2-equivalent or 4-equivalent cyan, magenta or yellow dye-forming couplers; leuco dye bases which oxidize to form a dye image (e.g., Malachite Green, Crystal Violet and pararosaniline); a combination of in situ silver halide, silver behenate, 3-methyl-1-phenylpyrazolone and N,N'-dimethyl-p-phenylenediamine hydrochloride; incorporating phenolic leuco dye reducing agents such as 2(3,5-di-(t-butyl)-4-hydroxyphenyl)-4,5-diphenylimidazole, and bis(3,5-di-(t-butyl)-4-hydroxyphenyl)phenylmethane, incorporating azomethine dyes or azo dye reducing agents; silver dye bleach processes (for example, an element comprising silver behenate, behenic acid, poly(vinyl butyral), poly(vinyl-butyral)peptized silver bromoiodide emulsion, 2,6-dichloro-4-benzenesulfonamidophenol, 1,8-(3,6-diazaoctane)bis (isothiuronium-p-toluenesulfonate) and an azo dye can be exposed and heat processed to obtain a negative silver image with a uniform distribution of dye, and then laminated to an acid activator sheet comprising polyacrylic acid, thiourea and p-toluenesulfonic acid and heated to obtain well defined positive dye images); and amines such as aminoacetanilide (yellow dye-forming), 3,3'-dimethoxybenzidine (blue dye-forming) or sulfanilide (magenta dye forming) that react with the oxidized form of incorporated reducing agents such as 2,6-dichloro-4-benzenesulfonamidophenol to form dye images. Neutral dye images can be obtained by the addition of amines such as behenylamine and p-anisidine.

Leuco dye oxidation in such silver halide systems for color formation is disclosed in U.S. Pat. Nos. 4,021,240, 4,374,821, 4,460,681 and 4,883,747.

Silver halide emulsions of this invention can be protected further against the additional production of fog and can be stabilized against loss of sensitivity during shelf storage. Suitable antifoggants, stabilizers, and stabilizer precursors which can be used alone or in combination, include thiazolium salts as described in U.S. Pat. Nos. 2,131,038 and 2,694,716; azaindenes as described in U.S. Pat. Nos. 2,886,437 and 2,444,605; mercury salts as described in U.S. Pat. No. 2,728,663; urazoles as described in U.S. Pat. No. 3,287,135; sulfocatechols as described in U.S. Pat. No. 3,235,652; oximes as described in British Pat. No. 623,448; nitrones; nitroindazoles; polyvalent metal salts as described in U.S. Pat. No. 2,839,405; thiouronium salts as described in U.S. Pat. No. 3,220,839; and palladium, platinum and gold salts described in U.S. Pat. Nos. 2,566,263 and 2,597,915; halogen-substituted organic compounds as described in U.S.

Pat. Nos. 4,108,665 and 4,442,202; triazines as described in U.S. Pat. Nos. 4,128,557; 4,137,079; 4,138,265; and 4,459,350; and phosphorous compounds as described in U.S. Pat. No. 4,411,985.

Emulsions of the invention can contain plasticizers and lubricants such as polyalcohols (e.g., glycerin and diols of the type described in U.S. Pat. No. 2,960,404); fatty acids or esters such as those described in U.S. Pat. No. 2,588,765 and U.S. Pat. No. 3,121,060; and silicone resins such as those described in British Pat. No. 955,061.

The photothermographic elements of the present invention may include image dye stabilizers. Such image dye stabilizers are illustrated by British Pat. No. 1,326,889; U.S. Pat. Nos. 3,432,300; 3,698,909; 3,574,627; 3,573,050; 3,764,337 and 4,042,394.

Photothermographic elements containing emulsion layers as described herein can contain matting agents such as starch, titanium dioxide, zinc oxide, silica, polymeric beads including beads of the type described in U.S. Pat. No. 2,992,101 and U.S. Pat. No. 2,701,245.

Emulsions in accordance with this invention can be used in photothermographic elements which contain antistatic or conducting layers, such as layers that comprise soluble salts (e.g., chlorides, nitrates, etc.), evaporated metal layers, ionic polymers such as those described in U.S. Pat. Nos. 2,861,056 and 3,206,312 or insoluble inorganic salts such as those described in U.S. Pat. No. 3,428,451.

The binder may be selected from any of the well-known natural or synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The preferred photothermographic silver containing polymers are polyvinyl butyral, ethyl cellulose, methacrylate copolymers, maleic anhydride ester copolymers, polystyrene, and butadiene-styrene copolymers. The antihalation layer must comprise a hydrophilic binder, preferably gelatin, polyvinyl alcohol, or polyvinyl pyrrolidone.

Optionally, these polymers may be used in combinations of two or more thereof. Such a polymer is used in an amount sufficient to carry the components dispersed therein, that is, within the effective range of the action as the binder. The effective range can be appropriately determined by one skilled in the art. As a guide in the case of carrying at least an organic silver salt, it can be said that a preferable ratio of the binder to the organic silver salt ranges from 15:1 to 1:2, and particularly from 8:1 to 1:1.

Photothermographic elements according to the present invention may be coated on a wide variety of supports. Typical supports include polyester film, subbed polyester film, poly(ethylene terephthalate) film, cellulose nitrate film, cellulose ester film, poly(vinyl acetal) film, polycarbonate film and related or resinous materials, as well as glass, paper, metal and the like. Typically, a flexible support is employed, especially a paper support, which may be partially acetylated or coated with baryta and/or an α-olefin polymer, particularly a polymer of an α-olefin containing 2 to 10 carbon atoms such as polyethylene, polypropylene, ethylene-butene copolymers and the like. Substrates may be transparent or opaque.

Substrates with a backside resistive heating layer may also be used in photothermographic imaging systems such as shown in U.S. Pat. Nos. 4,460,681 and 4,374,921.

Photothermographic elements of this invention can be coated by various coating procedures including dip coating, air knife coating, curtain coating, or extrusion coating using hoppers of the type described in U.S. Pat. No. 2,681,294. If desired, two or more layers may be coated simultaneously by the procedures described in U.S. Pat. No. 2,761,791 and British Pat. No. 837,095.

Additional layers may be incorporated into photothermographic articles of the present invention such as dye receptive layers for receiving a mobile dye image, an opacifying layer when reflection prints are desired, a protective topcoat layer and a primer layer as is known in the photothermographic art. Additionally, it may be desirable in some instances to coat different emulsion layers on both sides of a transparent substrate, especially when it is desirable to isolate the imaging chemistries of the different emulsion layers.

The following, non-limiting examples were performed to further enable practice of the present invention.

EXAMPLES 1–4

Two binder systems were prepared to test the potential infrared antihalation dyes in hydrophilic binders for photothermographic systems. The first binder system ingredients are listed below for a 100 gram batch.

| | |
|---|---|
| 7.50 g | poly(vinylalcohol) (Air Products, Vinol 523) |
| 46.23 g | deionized water |
| 46.22 g | methanol |
| 0.05 g | AH test dye |

The poly(vinylalcohol) (PVA) was added to the water with stirring. The temperature was raised to 190° F. and then mixed an additional 30 minutes. The temperature was lowered to 140° F. and the methanol was added very slowly with maximum agitation. The mixture was stirred an additional 30 minutes before cooling to room temperature.

The second binder solution ingredients are listed below. A bulk solution was prepared by soaking gelatin in deionized (DI) water for a half hour before raising the temperature to 104° F. (40° C.). A surfactant, Triton™ X-200, was added. The quantities are listed below.

| | |
|---|---|
| 95.5 g | DI Water |
| 4.2 g | Rouselot Gelatin |
| 0.30 g | Triton ™ X-200 |
| 0.05 g | AH test dye |

A further modification was the addition of a violet pigment. Dye D-2 was green-blue in color after coating whereas D-1 was more green-yellow. The green tone was eliminated with a violet pigment added at very low levels to give a light blue color to the D-2 dye oating and a neutral grey to D-1 after coating. The violet pigment was added as a 2% aqueous dispersion of Flexonyl Violet.

The dye D-2 was coated with and without the violet pigment (0.90 g 2% dispersion of violet pigment) in 100 g portions of the bulk gelatin solution maintained at 104° F. (40° C.). The solutions were coated on a knife coater with a 3 mil (0.075 mm) gap on 3 mil (0.075 mm) clear polyester. The coating was dried at 165° F. for 6 minutes. The absorbance spectrum had a 0.51 absorbance at the peak sensitivity of 765 nm and 0.40 absorbance at 780 nm where the laser diode emits. The visible absorbance (or color) of the coating was measured on a MacBeth TD 504 spectrophotometer with a broad band visible filter. Four strips were measured simultaneously to get a more accurate reading. The coating of the dye D-2 without violet pigment was green-blue in color and had a visible absorbance of 0.010. The coating with violet pigment gave an additional 0.010 of visible density so the coating in combination with the dye D-2 had a blue-grey cast and a 0.020 visible density. The blue tint of the antihalation coating would be more readily accepted for many applications such as medical of graphic arts films.

Two coatings were run with 0.05 g of dye D-1 per 100 g portions of the PVA binder formula. The solutions were coated with a 3 mil (0.075 mm) gap and dried at 180° F. for 4 minutes. The first coating was run without violet pigment, whereas the second contained 0.90 g of 2% dispersion of violet pigment. The infrared absorbance spectra was not affected by the violet pigment. The peak absorbance at 800 nm was 0.49 and the visible absorbance was 0.005 without violet and 0.015 with violet pigment. The addition of violet pigment changed the visible color from green-yellow to grey-blue.

Both systems (dye D-2 in gelatin and dye D-1 in PVA) show strong thermal stability. Neither bleaches during heat processing at 260° F. for. 10 seconds even with repeated attempts. The solutions are also stable and can be held overnight. No bleaching has been seen during drying operations so the antihalation layer could be coated first or last. The dye D-2 showed no change when coated samples were incubated at 120° F. and 50% RH for 2 weeks.

TABLE 1

| Example | AH Dye | Binder | Violet Pigment | λMax of Dye | Abs. λMax | Abs. 780 nm | Abs. 790 nm | Abs. 800 nm | Dye Color | Visible Absorbance (ave of 4) | Ratio IR/Visible |
|---|---|---|---|---|---|---|---|---|---|---|---|
| 1 | D-2 | gelatin | No | 765 nm | 0.51 | 0.40 | 0.30 | 0.21 | green-blue | 0.010 | 51 |
| 2 | D-2 | gelatin | Yes | 765 nm | 0.51 | 0.40 | 0.30 | 0.21 | blue-grey | 0.020 | |
| 3 | D-1 | PVA | No | 800 nm | 0.49 | 0.42 | 0.48 | 0.49 | green-yellow | 0.005 | 98 |
| 4 | D-1 | PVA | Yes | 800 nm | 0.49 | 0.42 | 0.48 | 0.49 | grey-blue | 0.015 | |

EXAMPLES 5–11

Additional water soluble, indolenine dyes were tested as potential infrared antihalation dyes in hydrophilic binders. The PVA resin system described in examples 1–4 was used. The dyes tested in PVA (0.05 g per 100 g binder solution) were added directly to the PVA binder solution. The solutions were coated on 3 mil (0.075 mm) clear polyester film and dried at 190° F. for four minutes. The dry coating weight was 3.3 g/m$^2$.

The results are summarized in Table 2. The coated films were evaluated on a spectrophotometer over a wavelength range of 360–900 nm. The results were tabulated for the wavelength of maximum absorbance ($\lambda_{max}$) and the absorbance at $\lambda_{max}$. Visible absorbance was calculated using a MacBeth 504 Densitometer with a visible filter. The reported visible absorbance is the difference between five strips of the AH test materials and five strips of raw polyester base divided by five. The ratio of IR/vis is the ratio of absorbance at $\lambda_{max}$ over the visible absorbance.

The results in Table 2 show that the indolenine dyes produce very effective antihalation systems for photothermographic systems. An effective antihalation level ($\lambda_{max}$ abs>0.30) can be achieved with a visible absorbance of less than 0.01. The indolenine dyes also show strong thermal stability which is critical in photothermographic systems. This is demonstrated in the last column (D&P, $\lambda_{max}$ abs) in Table 2 where the samples were dried an additional two times at 190° F. for four minutes and processed at 260° F. for ten seconds before repeating the absorbance reading.

TABLE 2

| Ex. | AH Dye | Binder | λmax (nm) | λmax abs | Visible abs | Ratio IR/vis | D&P $\lambda_{max}$ abs |
|---|---|---|---|---|---|---|---|
| 5 | D-1 | PVA | 801 | 0.55 | 0.005 | 110 | 0.57 |
| 6 | D-3 | PVA | 800 | 0.67 | 0.007 | 96 | 0.59 |
| 7 | D-4 | PVA | 762 | 0.32 | 0.007 | 46 | 0.32 |
| 8 | D-5 | PVA | 818 | 0.52 | 0.009 | 58 | 0.50 |
| 9 | D-6 | PVA | 823 | 0.30 | 0.005 | 60 | 0.31 |
| 10 | D-7 | PVA | 766 | 0.63 | 0.011 | 57 | 0.63 |
| 11 | D-2 | PVA | 767 | 0.61 | 0.009 | 68 | 0.60 |

EXAMPLES 12–15

The following constructions were coated to evaluate antihalation effects of the water soluble dyes for an infrared sensitized photothermographic material.

A silver halide-silver behenate dry soap was prepared by the procedure described in U.S. Pat. No. 3,839,049. The preformed silver halide emulsion was a 0.055 micron iodobromide emulsion with 2% iodide distributed uniformly thourghout the crystal. The silver halide totalled 9 mole % of the total silver while silver behenate comprised 91 mole % of the total silver.

The photothermographic emulsions were prepared by homogenizing 300 g of the silver halide-silver behenate dry soaps described above with 525 g toluene, 1675 g 2-butanone and 50 g poly(vinylbutyral) (B-76, Monsanto).

The homogenized photothermographic emulsion (500 g) and 100 g 2-butanone were cooled to 55° F. with stirring. Additional poly(vinylbutyral) (75.7 g B-76) was added and stirred for 20 minutes. Pyridinium hydrobromide perbromide (PHP, 0.45 g) was added and stirred for 2 hours. The addition of 3.25 ml of a calcium bromide solution (1 g of $CaBr_2$ and 10 ml of methanol) was followed by 30 minutes of stirring. The temperature was raised to 70° F. and the following were added in 15 minute increments with stirring:

3 g of 2-(4-chlorobenzoyl)benzoic acid IR Dye solution (8.8 mg of IR Dye, S-1, in 7.1 g DMF)

8.2 g of supersensitizer solution (0.21 g 2-mercaptobenzimidazole, MBI, and 8 g methanol) 16.2 g 1,1-bis(2-hydroxy-3,5-dimethylphenyl)-3,5,5-trimethylhexane.

1.70 g 2-(tribromomethylsulfone)benzothiazole 0.68 g Isocyanate (Desmodur N3300, Mobay)

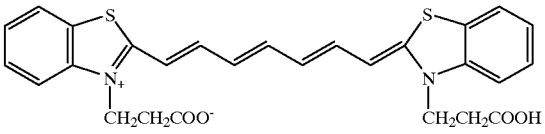

$S^{-1}$

The photothermographic emulsions were coated on 3 mil (0.075 mm) polyester base by means of a knife coater and dried at 175° F. for four minutes. The dry coating weight was 23 g/m$^2$.

0.005 absorbance unit due to the higher degree of error caused by subtracting out silver and topcoat contributions. Image quality was a qualitative evaluation in halation reduction caused by the antihalation dyes on examination of flair or halation on the continuous wedge used for sensitometry. The image quality scale ranges from 1 to 10 where 1 represents severe halation and 10 represents no halation even at high densities and overexposure.

The data in Table 3 confirm that the water soluble dyes in a hydrophilic binder can act as effective non-bleaching antihalation systems for photothermographic materials.

TABLE 3

| Ex | Dye | Layer | AH Dye (mg/m$^2$) | Binder | λmax* (nm) | λmax* (abs) | Dmin | Dmax | Speed | Δ Spd | Cont | Visible abs | Image Quality |
|---|---|---|---|---|---|---|---|---|---|---|---|---|---|
| A | none | — | — | — | — | — | 0.11 | 3.39 | 100 | — | 5.35 | 0 | 1 |
| 12 | D-3 | AHU | 22 | PVA | 800 | 0.62 | 0.11 | 3.41 | 42 | −0.38 | 4.68 | 0.005 | 9 |
| 13 | D-3 | AHB | 22 | PVA | 800 | 0.61 | 0.11 | 3.37 | 46 | −0.34 | 4.67 | 0.005 | 9 |
| 14 | D-1 | AHU | 22 | PVA | 800 | 0.60 | 0.11 | 3.42 | 43 | −0.37 | 5.23 | 0.005 | 9 |
| 15 | D-1 | AHB | 22 | PVA | 800 | 0.60 | 0.11 | 3.41 | 45 | −0.35 | 4.78 | 0.005 | 9 |

AHU = AH underlayer (between polyester and silver/topcoat coatings).
AHB = AH back layer (coated on opposite side of polyester from silver/topcoat coatings)
*Run vs Example A as background.

An active, protective topcoat solution was prepared with the following ingredients:

| | |
|---|---|
| 256.0 | acetone |
| 123.0 g | 2-butanone |
| 50.0 g | methanol |
| 20.2 g | cellulose acetate |
| 2.89 g | phthalazine |
| 1.52 g | 4-methylphthalic acid |
| 1.01 g | tetrachlorophthalic acid |
| 1.50 g | tetrachlorophthalic anhydride |

The topcoat solutions were coated over the silver layer at a dry weight of 3.0 g/m$^2$. The layer was dried at 175° F. for four minutes.

The following constructions were coated to evaluate antihalation effects.

| | |
|---|---|
| (Ex 12) | On polyester base having an underlayer of D-3 in PVA, as in Example 6. |
| (Ex 13) | On polyester base having a backing of D-3 in PVA, as in Example 6. |
| (Ex 14) | On polyester base having an underlayer of D-1 in PVA, as in Example 5. |
| (Ex 15) | On polyester base having a backing of D-1 in PVA, as in Example 5. |

The coated materials were then exposed with a laser sensitometer incorporating a 780 nm diode. After exposure, the film strips were processed at 260° F. for ten seconds. The wedges obtained were evaluated on a densitometer. Sensitometric results include Dmin, Dmax (the density value corresponding to an exposure at 1.40 logE beyond a density of 0.25 above Dmin), Speed (relative speed at a density of 1.0 above Dmin versus example A set at 100) Δspd (change in speed given in logE versus example A) and Cont (contrast measured as the slope of the line joining the density points of 0.50 and 1.70 above Dmin).

Table 3 also contains columns for visible absorbance and image quality. The visible absorbance corresponds to the antihalation dyes only and has been rounded to the nearest Comparative Examples B–D The antihalation dyes were also tested in a hydrophobic binder to determine the breadth of the invention. The hydrophobic binder solution ingredients are listed below for a 100 gram batch.

| | |
|---|---|
| 6.10 g | cellulose acetate butyrate (Eastman Kodak, CAB-381-20) |
| 63.85 g | 2-butanone |
| 30.00 g | 70/30 w/w mixture of methanol and 2-butanone (to dissolve AH test dye) |
| 0.06 g | AH test dye |

The antihalation dyes (0.06 g per 100 g finished binder solution) were first dissolved in the 70/30 mixture of methanol and 2-butanone. The dissolved dyes were then added to the CAB resin solution. The solutions were coated on 3 mil (0.075 mm) clear polyester film and dried at 185° F. for four minutes. The dry coating weight for the CAB binder solutions were 2.7 g/m$^2$.

Th results are compiled in Table 4. The infrared absorbance curves were very broad, and the dyes in a hydrophobic binder failed to achieve the 30 to 1 ratio of infrared peak absorbance to visible absorbance.

TABLE 4

| Ex. | AH dye | AH dye (mg/m$^2$) | Binder | $\lambda_{max}$ (nm) | $\lambda_{max}$ (abs) | Visible abs | Ratio IR/vis |
|---|---|---|---|---|---|---|---|
| B | D-1 | 25 | CAB | 731 | 0.21 | 0.020 | 10 |
| C | D-3 | 25 | CAB | 801 | 0.16 | 0.016 | 10 |
| D | D-2 | 25 | CAB | 754 | 0.14 | 0.016 | 9 |

We claim:

1. A photothermographic element comprising a substrate having on at least one side thereof a photothermographic system comprising silver halide spectrally sensitized to the infrared region of the electromagnetic spectrum, a light insensitive silver source, a reducing agent for silver ion, and a binder, said element further comprising at least one hydrophilic layer which contains an infrared-absorbing dye having a central nucleus of the formula

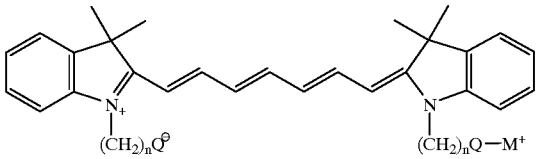

wherein n is an integer of 1 to 12,

Q is an ionic acidic moiety, and M is a cation, in an amount sufficient as to provide a transmission optical density of at least 0.1 at the wavelength of maximum sensitivity of said sensitized silver halide.

2. The element of claim 1 wherein said at least one layer is on the side of the substrate opposite that of the photothermographic system.

3. The element of claim 1 in which said at least one layer is present between said substrate and said photothermographic system.

4. The element of claim 1 wherein said at least one layer is present over said photothermographic system.

5. The element of claim 1 wherein n is 2 to 4.

6. The element of claim 2 wherein n is 2 to 4.

7. The element of claim 3 wherein n is 2 to 4.

8. The element of claim 1 wherein Q is $SO_3^-$.

9. The element of claim 5 wherein Q is $SO_3^-$.

10. The element of claim 6 wherein Q is $SO_3^-$.

11. The element of claim 1 wherein said dye has substituents on the shown fused benzo rings which are selected from the group consisting of acid groups, sulfonamido groups, and carbonamido groups.

12. The element of claim 5 wherein said dye has substituents on the shown fused benzo rings which are selected from the group consisting of acid groups, sulfonamido groups, and carbonamido groups.

13. The element of claim 6 wherein said dye has substituents on the shown fused benzo rings which are selected from the group consisting of acid groups, sulfonamido groups, and carbonamido groups.

14. The element of claim 7 wherein said dye has substituents on the shown fused benzo rings which are selected from the group consisting of acid groups, sulfonamido groups, and carbonamido groups.

15. The element of claim 8 wherein said dye has substituents on the shown fused benzo rings which are selected from the group consisting of acid groups, sulfonamido groups, and carbonamido groups.

16. The element of claim 1 wherein Q is selected from the group consisting of carboxylic acid, sulfonic acid, sulfinic acid, sulfonylic acid, phosphonic acid, and sulfonamido and carbonamido.

17. The element of claim 1 wherein M is selected from the group consisting of alkali metal and ammonium.

18. The element of claim 16 wherein M is selected from the group consisting of alkali metal and ammonium.

19. The element of claim 9 wherein Q is selected from the group consisting of carboxylic acid, sulfonic acid, sulfinic acid, sulfonylic acid, phosphonic acid, and the like, or sulfonamido or carbonamido.

20. The element of claim 19 wherein M is selected from the group consisting of alkali metal and ammonium.

* * * * *